US008770289B2

(12) United States Patent
Boone

(10) Patent No.: US 8,770,289 B2
(45) Date of Patent: Jul. 8, 2014

(54) METHOD AND SYSTEM FOR LIFTING FLUIDS FROM A RESERVOIR

(71) Applicant: Thomas A. Boone, Calgary (CA)

(72) Inventor: Thomas A. Boone, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 13/679,604

(22) Filed: Nov. 16, 2012

(65) Prior Publication Data

US 2013/0153218 A1 Jun. 20, 2013

(30) Foreign Application Priority Data

Dec. 16, 2011 (CA) ..... 2762451

(51) Int. Cl.
*E21B 43/24* (2006.01)
*E21B 36/00* (2006.01)

(52) U.S. Cl.
USPC ..... 166/272.4; 166/272.7; 166/272.6; 166/50; 166/302

(58) Field of Classification Search
None
See application file for complete search history.

(56) References Cited

U.S. PATENT DOCUMENTS

| | | | | | |
|---|---|---|---|---|---|
| 3,292,702 | A | | 12/1966 | Boberg et al. | 166/40 |
| 3,467,191 | A | * | 9/1969 | Van Daalen et al. | 166/269 |
| 3,705,625 | A | | 12/1972 | Whitten et al. | 166/252 |
| 3,739,852 | A | | 6/1973 | Woods et al. | 166/303 |
| 3,872,924 | A | | 3/1975 | Clampitt | 166/261 |
| 3,881,550 | A | * | 5/1975 | Barry | 166/272.6 |
| 4,004,636 | A | * | 1/1977 | Brown et al. | 166/401 |
| 4,116,275 | A | * | 9/1978 | Butler et al. | 166/303 |
| 4,265,310 | A | * | 5/1981 | Britton et al. | 166/259 |
| 4,280,559 | A | | 7/1981 | Best | 166/303 |
| 4,344,485 | A | * | 8/1982 | Butler | 166/271 |
| 4,397,612 | A | | 8/1983 | Kalina | |
| 4,418,752 | A | * | 12/1983 | Boyer et al. | 166/267 |
| 4,519,454 | A | * | 5/1985 | McMillen | 166/303 |
| 4,697,642 | A | | 10/1987 | Vogel | |
| 4,753,293 | A | | 6/1988 | Bohn | |
| 4,773,257 | A | | 9/1988 | Aselsen et al. | 73/61.1 |
| 4,948,393 | A | | 8/1990 | Hodson et al. | 55/40 |
| 5,016,709 | A | | 5/1991 | Combe et al. | |
| 5,141,054 | A | | 8/1992 | Alameddine et al. | 166/252 |

(Continued)

FOREIGN PATENT DOCUMENTS

| | | | |
|---|---|---|---|
| CA | 1246993 | 12/1988 | E21B 43/28 |
| CA | 2015460 | 10/1991 | |

(Continued)

OTHER PUBLICATIONS

Butler, et al., (1991) "A New Process (Vapex) for Recovering Heavy Oils," *JCPT*, vol. 30, No. 1, pp. 97-106.

(Continued)

*Primary Examiner* — Angela M DiTrani
*Assistant Examiner* — Anuradha Ahuja
(74) *Attorney, Agent, or Firm* — ExxonMobil Upstream Research Company Law Department

(57) ABSTRACT

Systems and methods are provided for lifting hydrocarbons from reservoirs. A method includes injecting a heat carrier fluid comprising steam, hot water, or both into a first well and injecting an organic compound into a second well. The organic compound is selected to vaporize to a gas from the heat provided by the heat carrier fluid, forcing produced fluids to the surface. The produced fluids are collected at the surface.

26 Claims, 4 Drawing Sheets

(56) References Cited

U.S. PATENT DOCUMENTS

| | | | | | |
|---|---|---|---|---|---|
| 5,148,869 | A * | 9/1992 | Sanchez | 166/303 | |
| 5,215,149 | A * | 6/1993 | Lu | 166/303 | |
| 5,289,881 | A | 3/1994 | Schuh | 166/303 | |
| 5,355,948 | A | 10/1994 | Sparlin et al. | 166/228 | |
| 5,411,094 | A | 5/1995 | Northrop | 166/303 | |
| 5,413,175 | A * | 5/1995 | Edmunds | 166/252.1 | |
| 5,450,902 | A | 9/1995 | Matthews | | |
| 5,607,016 | A | 3/1997 | Butler | | |
| 5,655,605 | A | 8/1997 | Matthews | | |
| 5,685,371 | A | 11/1997 | Richardson et al. | | |
| 5,730,223 | A | 3/1998 | Restarick | 166/380 | |
| 5,771,973 | A * | 6/1998 | Jensen et al. | 166/303 | |
| 5,826,655 | A | 10/1998 | Snow et al. | 166/272.3 | |
| 5,860,475 | A | 1/1999 | Ejiogu et al. | 166/245 | |
| 5,899,274 | A * | 5/1999 | Frauenfeld et al. | 166/401 | |
| 5,957,205 | A | 9/1999 | Bohme et al. | 166/296 | |
| 6,158,510 | A | 12/2000 | Bacon et al. | 166/272.7 | |
| 6,230,814 | B1 * | 5/2001 | Nasr et al. | 166/400 | |
| 6,257,334 | B1 | 7/2001 | Cyr et al. | 166/272.7 | |
| 6,318,468 | B1 * | 11/2001 | Zakiewicz | 166/305.1 | |
| 6,591,908 | B2 | 7/2003 | Nasr | | |
| 6,662,872 | B2 | 12/2003 | Gutek et al. | 166/272.4 | |
| 6,708,759 | B2 * | 3/2004 | Laute et al. | 166/272.4 | |
| 6,729,394 | B1 * | 5/2004 | Hassan et al. | 166/245 | |
| 6,769,486 | B2 | 8/2004 | Lim et al. | 166/263 | |
| 6,883,607 | B2 | 4/2005 | Nenniger et al. | | |
| 6,988,549 | B1 | 1/2006 | Babcock | | |
| 7,363,973 | B2 * | 4/2008 | Nenniger et al. | 166/272.4 | |
| 7,527,096 | B2 | 5/2009 | Chung et al. | | |
| 7,556,099 | B2 | 7/2009 | Arthur et al. | | |
| 7,591,309 | B2 | 9/2009 | Minnich et al. | 166/266 | |
| 7,591,311 | B2 | 9/2009 | Minnich et al. | 166/272.3 | |
| 7,717,175 | B2 | 5/2010 | Chung et al. | | |
| 7,900,701 | B2 | 3/2011 | Weiers et al. | 166/251.1 | |
| 7,931,083 | B2 | 4/2011 | Betzer-Tsilevich | 166/272.3 | |
| 2005/0082067 | A1 | 4/2005 | Good et al. | | |
| 2005/0211434 | A1 * | 9/2005 | Gates et al. | 166/272.3 | |
| 2007/0168170 | A1 | 7/2007 | Thomas | | |
| 2007/0199697 | A1 * | 8/2007 | Hocking | 166/250.1 | |
| 2007/0199699 | A1 * | 8/2007 | Hocking | 166/250.01 | |
| 2008/0017372 | A1 * | 1/2008 | Gates et al. | 166/254.1 | |
| 2009/0133643 | A1 | 5/2009 | Suggett et al. | 122/1 B | |
| 2009/0272533 | A1 * | 11/2009 | Burns et al. | 166/272.7 | |
| 2009/0288827 | A1 | 11/2009 | Coskuner | 166/272.3 | |
| 2010/0206565 | A1 | 8/2010 | Embry et al. | 166/272.3 | |
| 2010/0276140 | A1 | 11/2010 | Edmunds et al. | | |
| 2011/0120709 | A1 * | 5/2011 | Nasr et al. | 166/272.3 | |
| 2011/0186292 | A1 * | 8/2011 | Wheeler et al. | 166/272.3 | |
| 2011/0186295 | A1 * | 8/2011 | Kaminsky et al. | 166/302 | |
| 2011/0290503 | A1 * | 12/2011 | Boone | 166/369 | |
| 2012/0048382 | A1 | 3/2012 | James | | |
| 2012/0059640 | A1 | 3/2012 | Roy et al. | | |
| 2012/0325470 | A1 | 12/2012 | Gupta et al. | | |
| 2013/0045902 | A1 | 2/2013 | Thompson et al. | | |
| 2013/0146285 | A1 | 6/2013 | Chhina et al. | | |

FOREIGN PATENT DOCUMENTS

| | | | | |
|---|---|---|---|---|
| CA | 1304287 | 6/1992 | | |
| CA | 2147079 | 10/1996 | | |
| CA | 2241478 | 12/1999 | | E21B 43/24 |
| CA | 2250648 | 4/2000 | | |
| CA | 2281276 | 2/2001 | | |
| CA | 2304938 | 2/2001 | | |
| CA | 2785871 | 8/2001 | | |
| CA | 2243105 | 11/2001 | | E21B 43/22 |
| CA | 2313837 | * 1/2002 | | |
| CA | 2251157 | 5/2003 | | E21B 43/24 |
| CA | 2219513 | 6/2003 | | E21B 43/24 |
| CA | 2313837 | 9/2004 | | E21B 43/24 |
| CA | 2494391 | 7/2006 | | E21B 43/24 |
| CA | 2594413 | 7/2006 | | E21B 43/243 |
| CA | 2584712 | 10/2008 | | E21B 43/16 |
| CA | 2591498 | 2/2010 | | E21B 43/16 |
| CA | 2655852 | 4/2010 | | |
| CA | 2621991 | 9/2010 | | E22B 33/00 |
| CA | 2698898 | 7/2011 | | |
| CA | 2714646 | 3/2012 | | E21B 43/30 |
| CA | 2740941 | 11/2012 | | |
| CA | 2778135 | 11/2012 | | |
| EP | 0786577 | 7/1997 | | E21B 43/08 |
| WO | WO2007/050180 | 5/2007 | | E21B 43/00 |

OTHER PUBLICATIONS

Davies, D. K. et al. (1997) "A Novel, Low Cost, Well Completion Technique Using Steam for Formations With Unconsolidated Sands, Wilmington Field, California," *SPE Ann. Tech. Conf.*, San Antonio, Texas, SPE 38793, pp. 433-447.

Donnelly (1999) "Hilda Lake a Gravity Drainage Success," *SPE Int'l Thermal Operations and Heavy Oil Symposium*, Bakersfield, CA, SPE 54093, 7 pages.

Edie et al. (2003) "Meander Belt Entrapment of Hydrocarbons at Saddle Lake, Alberta and an Untested In Situ Combustion Scheme for Recovery of Heavy Oil," *Bulletin of Canadian Petroleum Geology*, v. 51, No. 3, pp. 253-274.

Granger, M. J. et al. (1996) "Horizontal Well Applications in the Guymon-Hugoton Field: A Case Study," *Gas Tech. Conf.*, Calgary, Alberta, Canada, SPE 35641, pp. 1-10.

Kisman, et al. (1995) "Numerical Simulation of the SAGD Process in the Burnt Lake Oil Sands Lease," *SPE Int'l Heavy Oil Symposium*, Calgary, Alberta, SPE 30276, pp. 275-286.

Montgomery, S. L. (1998) "Increasing Reserves in a Mature Giant: Wilmington Field, Los Angeles Basin, Part II: Improving Heavy Oil Production Through Advanced Reservoir Characterization and Innovative Thermal Technologies," *AAPG Bulletin*, v. 82, No. 4, pp. 531-544.

Nelson et al. (1961) "How to Engineer an In Situ Combustion Project," *The Oil and Gas Journal*, p. 58.

(1991) "Thermal Recovery of Oil and Bitumen," *Prentice Hall*, p. 292.

* cited by examiner

100

200

400

METHOD AND SYSTEM FOR LIFTING FLUIDS FROM A RESERVOIR

CROSS REFERENCE TO RELATED APPLICATIONS

This application claims the priority benefit of Canadian Patent Application 2,762,451 filed Dec. 16, 2011 entitled METHOD AND SYSTEM FOR LIFTING FLUIDS FROM A RESERVOIR, the entirety of which is incorporated by reference herein.

FIELD

The present techniques relate to the use of steamflooding to recover hydrocarbons. Specifically, techniques are disclosed for utilizing solvents to facilitate lifting materials in steam assisted gravity drainage wells.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Modern society is greatly dependant on the use of hydrocarbons for fuels and chemical feedstocks. However, easily harvested sources of hydrocarbon are dwindling, leaving less accessible sources to satisfy future energy needs. As the costs of hydrocarbons increase, these less accessible sources become more economically attractive. For example, the harvesting of oil sands to remove hydrocarbons has become more extensive as it has become more economical. The hydrocarbons harvested from these reservoirs may have relatively high viscosities, for example, ranging from 8 API, or lower, up to 20 API, or higher. Accordingly, the hydrocarbons may include heavy oils, bitumen, or other carbonaceous materials, collectively referred to herein as "heavy oil," which are difficult to recover using standard techniques.

Several methods have been developed to remove hydrocarbons from oil sands. For example, strip or surface mining may be performed to access the oil sands, which can then be treated with hot water or steam to extract the oil. However, deeper formations may not be accessible using a strip mining approach. For these formations, a well can be drilled to the reservoir and steam, hot air, solvents, or combinations thereof, can be injected to release the hydrocarbons. The released hydrocarbons may then be collected by the injection well or by other wells and brought to the surface.

A number of techniques have been developed for harvesting heavy oil from subsurface formations using thermal recovery techniques. Thermal recovery operations are used around the world to recover liquid hydrocarbons from both sandstone and carbonate reservoirs. These operations include a suite of in-situ recovery techniques that may be based on steam injection, solvent injection, or both. These techniques may include cyclic steam stimulation (CSS), steamflooding, and steam assisted gravity drainage (SAGD), as well as their corresponding solvent based techniques.

For example, CSS techniques include a number of enhanced recovery methods for harvesting heavy oil from formations that use steam heat to lower the viscosity of the heavy oil. The CSS process may raise the steam injection pressure above the formation fracturing pressure to create fractures within the formation and enhance the surface area access of the steam to the heavy oil, although CSS may also be practiced at pressures that do not fracture the formation. The steam raises the temperature of the heavy oil during a heat soak phase, lowering the viscosity of the heavy oil. The injection well may then be used to produce heavy oil from the formation. The cycle is often repeated until the cost of injecting steam becomes uneconomical, for instance if the cost is higher than the money made from producing the heavy oil. However, the steam in successive steam injection cycles reenters earlier created fractures and, thus, the process becomes less efficient over time. CSS is practiced using both vertical and horizontal wells.

Solvents may be used in combination with steam in CSS processes, such as in mixtures with the steam or in alternate injections between steam injections. The solvents are typically liquid hydrocarbons at surface conditions that may be directly mixed and flashed into the injected steam lines or injected into the CSS wellbores and further transported as vapours to contact heavy oil surrounding steamed areas between adjacent wells. The injected hydrocarbons may be produced as a solution in the heavy oil phase. The loading of the liquid hydrocarbons injected with the steam can be chosen based on pressure drawdown and fluid removal from the reservoir using lift equipment in place for the CSS.

As a field ages, the use of CSS may gradually be replaced with non-cyclic techniques, for example, in which steam is continuously injected into a first well, and fluids are continuously produced from a second well. These techniques may generally be termed steamflooding, and are generally based on vertical wells. However, the use of horizontal wells is becoming more common. Steam and any other vaporized injected fluids have a tendency to override the hydrocarbons in the formation, and directly travel from injector to producer, potentially lowering their effectiveness in recovering the oil.

Another group of techniques is based on a continuous injection of steam through a first well to lower the viscosity of heavy oils and a continuous production of the heavy oil from a lower-lying second well. Such techniques may be termed "steam assisted gravity drainage" or SAGD.

In SAGD, two horizontal wells are completed into the reservoir. The two wells are first drilled vertically to different depths within the reservoir. Thereafter, using directional drilling technology, the two wells are extended in the horizontal direction that result in two horizontal wells, vertically spaced from, but otherwise vertically aligned with the other. Ideally, the production well is located above the base of the reservoir but as close as practical to the bottom of the reservoir, and the injection well is located vertically 3 to 10 metres (10 to 30 feet) above the horizontal well used for production.

The upper horizontal well is utilized as an injection well and is supplied with steam from the surface. The steam rises from the injection well, permeating the reservoir to form a vapour chamber that grows over time towards the top of the reservoir, thereby increasing the temperature within the reservoir. The steam, and its condensate, raise the temperature of the reservoir and consequently reduce the viscosity of the heavy oil in the reservoir. The heavy oil and condensed steam will then drain downward through the reservoir under the action of gravity and may flow into the lower production well, whereby these liquids can be pumped to the surface. At the surface, the liquids flow into processing facilities where the condensed steam and heavy oil are separated, and the heavy oil may be diluted with appropriate light hydrocarbons for transport by pipeline.

However, the techniques discussed above may have difficulty with removing fluids from the well bore. Artificial lifting techniques can be used to boost the amount of fluids removed from reservoirs. Such techniques include, for example, pumps, gas lift, and the like. Pumps can include surface driven pumps, such as pump jacks and the like. However, pumpjacks may not be efficient for heavy oil recovery, due to variations in flow rates, pressures, and material viscosities. Pump jacks may also have limited volumetric capacity. Down hole electrical pumps can be more effective, but may not operate well at the higher temperatures present during a high temperature recovery process, such as a steam assisted hydrocarbon production. Gas lift systems may provide a method for harvesting fluids, but require large amounts of high pressure gas be driven into the well and the associated infrastructure to supply the gas. The compression and recovery of the gas may add a significant cost to the field. In some cases natural lift is sufficient for most of the operating period and supplemental lift so an inexpensive supplemental lift system is all that is required. Thus, research has continued in techniques for lifting fluids from reservoirs.

U.S. Pat. No. 4,397,612 to Kalina, et al., discloses a gas lift system utilizing a liquefiable gas that is introduced into a well. The method includes introducing a liquid into a first well conduit to maintain a liquid level and provide a significant liquid column pressure at the downhole region of the well. The fluid passes into a second well conduit to mix with well fluid in the second conduit and cause lifting of the well fluid in the second well conduit.

In the system described above, the lifting occurs as pressure is relieved on the liquid, allowing the liquid to flash and form gas bubbles, which drive the fluids to the surface. However, the flashing of the fluids removes energy from the environment and, thus, sufficient thermal energy must be present for the flashing to occur. Further, the liquid is prevented from flashing in the first conduit by the liquid level.

SUMMARY

An embodiment described herein provides a method for lifting fluids from a reservoir. The method includes injecting a heat carrier fluid including steam, hot water, or both into a first well. An organic compound is injected into a second well, wherein the organic compound is selected to vaporize to a gas from the heat provided by the heat carrier fluid, forcing produced fluids to the surface through the second well. The produced fluids are collected at the surface.

Another embodiment provides a system for harvesting resources in a reservoir. The system includes a production well that includes a horizontal section located substantially proximate to a base of the reservoir. An injection system is configured to inject an organic compound into a tube in the production well, wherein the organic compound is selected so as to vaporize at the end of the tube. A continuous production system is configured to produce a fluid from the production well, wherein the fluid includes a bitumen and the organic compound.

Another embodiment provides a method for harvesting hydrocarbons from a reservoir. The method includes drilling a production well substantially proximate to a base of a reservoir. Steam is injected into the reservoir to lower a viscosity of bitumen, wherein the bitumen flows into the production well. An organic compound is injected in the liquid phase into the production well, wherein the organic compound flashes into a vapour in the production well. Fluids are produced from the production well, wherein the fluids include the vapour and the bitumen.

DESCRIPTION OF THE DRAWINGS

The advantages of the present techniques are better understood by referring to the following detailed description and the attached drawings, in which.

DETAILED DESCRIPTION

Figure 1:
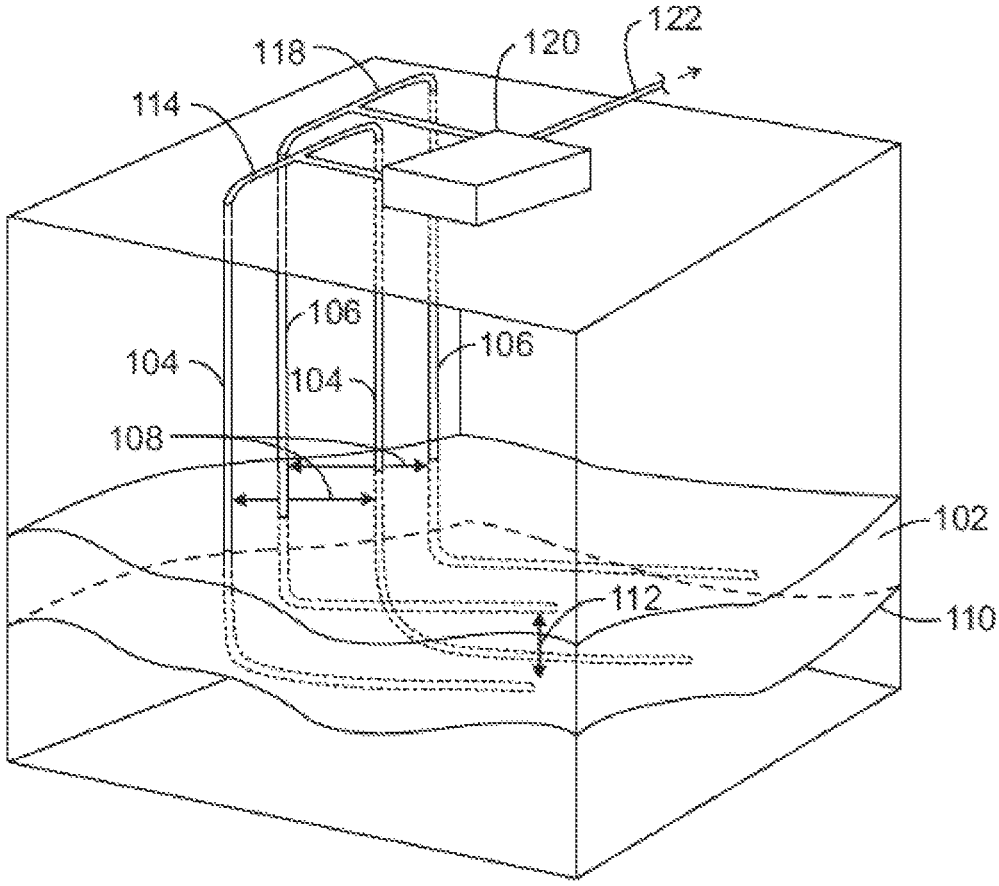
FIG. 1 is a drawing of a hydrocarbon recovery process that can use a solvent assisted gas lift system to produce fluids from a reservoir.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the term a "base" of a reservoir indicates a lower boundary of the resources in a reservoir that are practically recoverable, by a gravity-assisted drainage technique, for example, using an injected mobilizing fluid, such as steam, solvents, hot water, gas, and the like. The base may be considered a lower boundary of a pay zone, e.g., the zone from which hydrocarbons may generally be removed by gravity drainage. The lower boundary may be an impermeable rock layer, including, for example, granite, limestone, sandstone, shale, and the like. The lower boundary may also include layers that, while not completely impermeable, impede the formation of fluid communication between a well on one side and a well on the other side. Such layers may include broken shale, mud, silt, and the like. The resources within the reservoir may extend below the base, but the resources below the base may not be recoverable with gravity assisted techniques.

"Bitumen" is a naturally occurring heavy oil material. Generally, it is the hydrocarbon component found in oil sands. Bitumen can vary in composition depending upon the degree of loss of more volatile components. It can vary from a very viscous, tar-like, semi-solid material to solid forms. The hydrocarbon types found in bitumen can include aliphatics, aromatics, resins, and asphaltenes. A typical bitumen might be composed of:

19 wt. % aliphatics (which can range from 5 wt. %-30 wt. %, or higher);

19 wt. % asphaltenes (which can range from 5 wt. %-30 wt. %, or higher);

30 wt. % aromatics (which can range from 15 wt. %-50 wt. %, or higher);

32 wt. % resins (which can range from 15 wt. %-50 wt. %, or higher); and some amount of sulphur (which can range in excess of 7 wt. %).

In addition bitumen can contain some water and nitrogen compounds ranging from less than 0.4 wt. % to in excess of 0.7 wt. %. As used herein, the term "heavy oil" includes bitumen, as well as lighter materials that may be found in a sand or carbonate reservoir.

As used herein, a "cyclic recovery process" uses an intermittent injection of injected mobilizing fluid selected to lower the viscosity of heavy oil in a hydrocarbon reservoir. The injected mobilizing fluid may include steam, solvents, gas, water, or any combinations thereof. After a soak period, intended to allow the injected material to interact with the heavy oil in the reservoir, the material in the reservoir, including the mobilized heavy oil and some portion of the mobilizing agent may be harvested from the reservoir. Cyclic recovery processes use multiple recovery mechanisms, in addition to gravity drainage, early in the life of the process. The significance of these additional recovery mechanisms, for example dilation and compaction, solution gas drive, water flashing, and the like, declines as the recovery process matures. Practically speaking, gravity drainage is the dominant recovery mechanism in most mature thermal, thermal-solvent and solvent based recovery processes used to develop heavy oil and bitumen deposits, such as steam assisted gravity drainage (SAGD). For this reason the approaches disclosed here are equally applicable to all recovery processes in which at the current stage of depletion gravity drainage is the dominant recovery mechanism.

"Facility" as used in this description is a tangible piece of physical equipment through which hydrocarbon fluids are either produced from a reservoir or injected into a reservoir, or equipment which can be used to control production or completion operations. In its broadest sense, the term facility is applied to any equipment that may be present along the flow path between a reservoir and its delivery outlets. Facilities may comprise production wells, injection wells, well tubulars, wellhead equipment, gathering lines, manifolds, pumps, compressors, separators, surface flow lines, steam generation plants, processing plants, and delivery outlets. In some instances, the term "surface facility" is used to distinguish those facilities other than wells.

As used herein, "heavy oil" includes both oils that are classified by the American Petroleum Institute (API) as heavy oils and extra heavy oils, which are also known as bitumen. In general, a heavy oil has an API gravity between 22.3° (density of 920 kg/m$^3$ or 0.920 g/cm$^3$) and 10.0° (density of 1,000 kg/m$^3$ or 1 g/cm$^3$). An extra heavy oil, or bitumen, in general, has an API gravity of less than 10.0° (density greater than 1,000 kg/m$^3$ or greater than 1 g/cm$^3$). For example, a common source of heavy oil includes oil sand or bituminous sand, which is a combination of clay, sand, water, and heavy oil. The thermal recovery of heavy oils is based on the viscosity decrease of fluids with increasing temperature. Solvent-based recovery processes are based on reducing the liquid viscosity by mixing heavy oil with a solvent. Once the viscosity is reduced, the movement or drive of the fluids may be forced by steam or hot water flooding, and gravity drainage becomes possible. The reduced viscosity makes the drainage quicker and therefore directly contributes to the recovery rate.

As used herein, a "horizontal well" generally refers to a well bore with a section having a centerline which departs from vertical by at least about 80°. This nearly horizontal section is often used for harvesting hydrocarbons in a reservoir. Generally, the nearly horizontal section of a well bore that is used for gravity production of heavy oils extends for several hundred meters in a reservoir from the "heel" to the "toe." The heel is closest to the portion of the well bore that leads to the surface, while the toe is farthest from the portion of the well bore that leads to the surface. In practice, the horizontal well will often be drilled such that it conforms to the base of the reservoir so that the toe may be shallower or deeper than the heel of the well.

A "hydrocarbon" is an organic compound that primarily includes the elements hydrogen and carbon, although nitrogen, sulphur, oxygen, metals, or any number of other elements may be present in small amounts. As used herein, hydrocarbons generally refer to components found in heavy oil, or other oil sands. Liquid hydrocarbon solvents are hydrocarbons that are substantially in the liquid phase at surface conditions, such as pentane, hexane, heptanes, heavier hydrocarbons, or mixtures thereof. Light hydrocarbon solvents, such as ethane, propane, butane, or mixture thereof, are hydrocarbons that are substantially in the gas phase or cycling between the liquid and gas phase, under the temperature and pressure conditions found at surface.

A non-condensable gas is a gas that is in the gas phase under the temperature and pressure conditions found in an oil-sands reservoir. Such gases can include carbon dioxide ($CO_2$), methane ($CH_4$), and nitrogen ($N_2$), among others.

"Permeability" is the capacity of a rock or sand to transmit fluids through the interconnected pore spaces. The customary unit of measurement is the millidarcy. Relative permeability refers to the fractional permeability of the absolute permeability for a specific phase, such as oil, water or gas.

As used herein, a "reservoir" is a subsurface rock or sand formation from which a production fluid, or resource, can be harvested. The rock formation may include sand, sandstone, granite, silica, carbonates, clays, shales and organic matter, such as oil, gas, or coal, among others. Reservoirs can vary in thickness from less than one foot (0.3048 m) to hundreds of feet (hundreds of m). The common feature of a reservoir is that it has pore space within the rock that may be impregnated with a heavy oil.

As discussed above, "steam assisted gravity drainage" (SAGD), is a thermal recovery process in which steam, or a combination of steam and solvents, is injected into a first well to lower a viscosity of a heavy oil, and fluids are recovered from a second well. Both wells are generally horizontal in the formation and the first well lies above the second well. Accordingly, the reduced viscosity heavy oil flows down to the second well under the force of gravity, although pressure differential may provide some driving force in various applications.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, "thermal recovery processes" include any type of hydrocarbon recovery process that uses a heat source to enhance the recovery, for example, by lowering the viscosity of a hydrocarbon. These processes may use injected mobilizing fluids, such as hot water, wet steam, dry steam, or solvents alone, or in any combinations, to lower the viscosity of the hydrocarbon. Such processes may include subsurface processes, such as cyclic steam stimulation (CSS), cyclic solvent stimulation, steamflooding, solvent injection, and SAGD, among others, and processes that use surface processing for the recovery, such as sub-surface mining and surface mining. Any of the processes referred to herein, such as SAGD may be used in concert with solvents.

A "well" is a hole in the subsurface made by drilling and inserting a conduit into the subsurface. A well may have a substantially circular cross section or any other cross-sectional shape, such as an oval, a square, a rectangle, a triangle, or other regular or irregular shapes. As used herein, the term "wellbore," when referring to an opening in the formation, may be used interchangeably with the term "well." Multiple pipes or lines may be inserted into a single wellbore, for example, as an outer annulus, an inner annulus, and a center pipe or tube. The portion of a well that is intended to harvest a resource, such as a heavy oil or other hydrocarbon, may have devices to allow flow of the resource into the well. Such devices may include sand filters, inflow control devices, and the like.

Overview

Embodiments described herein provide solvent-based gas lift methods and systems for wells that are powered by heat provided from a surface location. In the system, an organic compound is injected into the well as a liquid, for example, through a tube or annulus reaching to the heel of the well. The liquid organic compound is selected to flash into a vapour at the temperature and pressure conditions found at the heel of the well once mixed with the produced fluids, or within the tube or annulus before reaching to the heel of the well. The vapour formed from the organic compound then forces liquid up the well by the formation of bubbles that lower the hydrostatic pressure of the liquid column in the well. At the surface, separation equipment may remove water from the organic liquids. If the lift was used to harvest a compound that is diluted before shipment, such as bitumen, the organic compound may be a diluent that is left in the mixture when shipped. If the lift was used to remove steam condensate or water from a well, the organic compound may be reused in the lifting process.

The techniques described herein may provide considerable benefits in SAGD and solvent-assisted SAGD processes. During the warm-up phase for the SAGD process when steam is injected down the inner tubing (as discussed with respect to FIG. 1, below) it is not practical to have a pump in the wellbore to aid with fluid lift since the steam injection will generally be performed using the tubing that would normally be used for production. Furthermore, facilities that provide high pressure gas for gas lift are expensive to install and may not be present. Nonetheless, particularly if the well is located near a basal water zone the bottomhole pressure may be limited and some form of artificial lift may be required. A system that consists of a tank of liquid hydrocarbons (typically pentane, hexane, heavier hydrocarbons or mixtures thereof such as natural gas condensates or diluent), a pump and a flowline to the wellhead offer a simple and effective alternative. The method is particularly applicable to solvent-assisted SAGD where facilities are in-place for the purpose of adding solvent to the steam for direct injection into the reservoir where it may be preferable to use the same solvent that is used in a solvent-assisted recovery process. Alternatively a solvent may be chosen that would otherwise be added in the facilities to aid in processing or separation of hydrocarbons from water.

FIG. 1 is a drawing of a hydrocarbon recovery process 100 that can use a solvent assisted gas lift system to produce fluids from a reservoir 102. In the hydrocarbon recovery process 100, the reservoir 102 is accessed by a set of production wells 104 and a set of injection wells 106. Each of the wells 104 and 106 may have a horizontal segment that follows the reservoir. As described herein, the wells can have a lateral spacing 108 of about 50 to 200 metres between each of the wells. The first set 104 may be drilled substantially proximate to a base 110 of the reservoir 102. The second set 106 of horizontal wells may be drilled at a vertical spacing 112 of about three metres, or more, above the first set 104. Although only two wells of each type are shown in the hydrocarbon recovery process 100, any number may be used, for example, from one well of each type to several hundred wells of each type, depending on the size of the reservoir 102. The first set 104 of horizontal wells may be coupled together by lines 114 at the surface. Similarly, the second set 106 of horizontal wells may be coupled together by lines 118 at the surface. One or more surface facilities 120 produce steam or solvent streams that can be injected into the reservoir through the sets of wells 104 or 106 and produce fluids from the sets of wells 104 or 106. In an embodiment, solvent may be injected through one or both sets of wells 104 or 106, for example, through a tube or annulus in the well. The solvent is selected to vaporize at the conditions in the well, providing a vapour at the heel of the well that can drive a gas lift assisting in the production of fluids from the well.

The produced fluids may be separated at the surface facility 120 to produce a hydrocarbon stream 122, which can then be sent on for further processing. The solvent may be separated from the produced fluids at the surface and reused in the lift system, or may be left in the hydrocarbon stream 122 as a diluent used for transport.

After the sets of wells 104 and 106 are drilled, a cyclic production process, such as cyclic steam stimulation, may be used on both sets 104 and 106 of horizontal wells in concert. During this period, the surface lines 114 and 118 may be tied together so that the sets of wells 104 and 106 are used in concert. The cyclic production process is repeated until fluid communication between the first set 104 and the second set 106 of wells is detected. During the cyclic production process, an injection of a solvent that flashes at well conditions may be used to assist in the production of water from steam condensation, the production of bitumen or other hydrocarbons, or both.

Solvent Gas Lift Process

Figure 2:
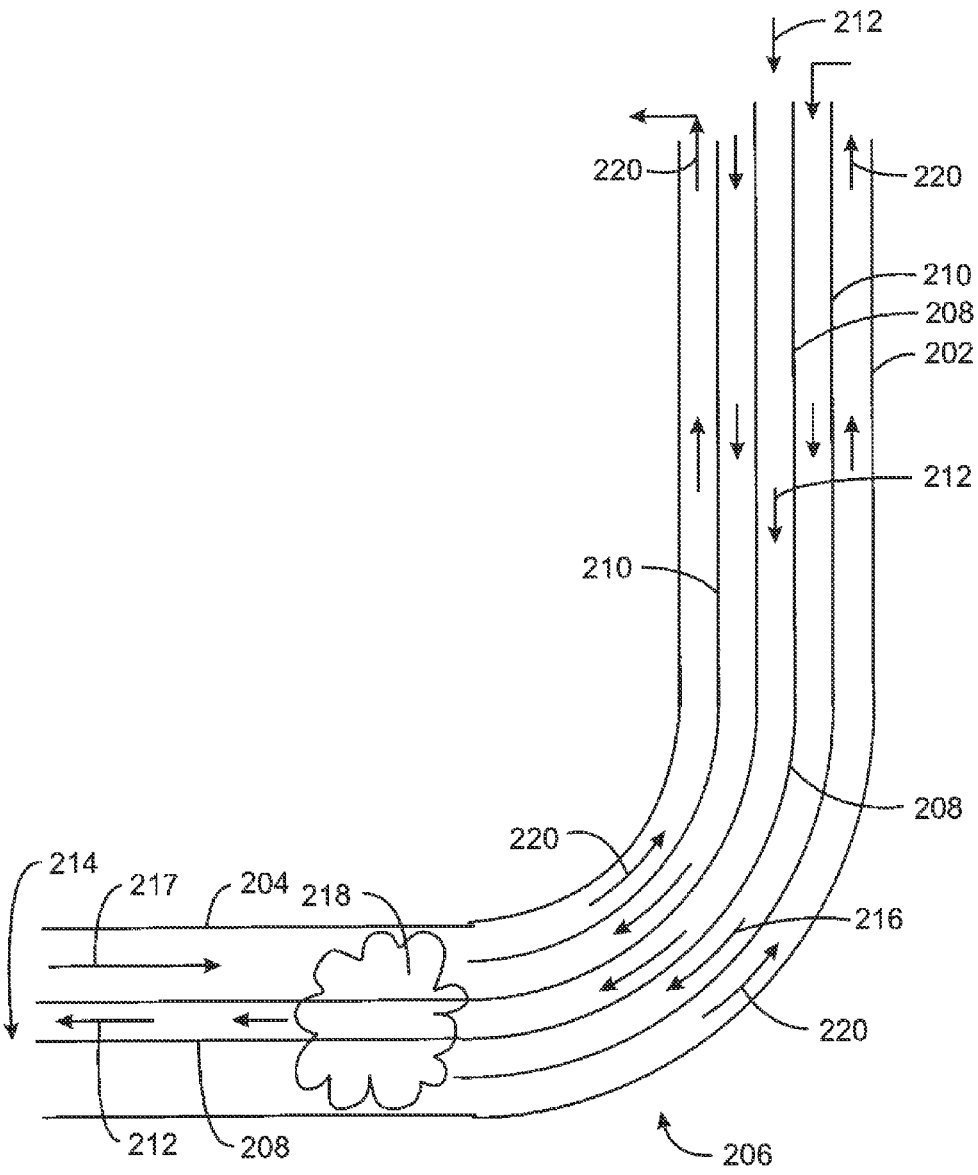
FIG. 2 is a schematic of a solvent injection process that can be used to provide a gas lift in a single well.

FIG. 2 is a schematic of a solvent injection process that can be used to provide a gas lift in a single well 200. The well 200 has an upper section 202 that is substantially vertical and a production liner 204 that is substantially horizontal. The production liner 204 starts when the well 200 transitions from vertical to horizontal at the heel 206 of the well.

The upper section 202 of the well 200 may contain multiple nested or adjacent tubulars 208 and 210 within the outer casing of the upper section 202. For example, a central tubular 208 can be used to carry steam 212 into the well 200 and may extend to the toe 214 of the well 200. However, the central tubular 208 does not have to extend to the toe 214 of the well 200, but may end at any appropriate point in the production liner 204.

A middle tubular 210 may enclose the central tubular 208 and can be used for the introduction of solvent 216 into the well 200 through the annulus surrounding the central tubular 208. The middle tubular 210 can end at the heel 206 of the well 200, depositing the solvent 216 at the heel 206, or may extend further into the production liner 204. The solvent 216 will flash to a vapour 218, either as it travels down the middle tubular 210 or as it exits the annulus between the middle tubular 210 and the central tubular 208. The energy for flashing can be provided by heat from a return flow 217, for example, of hot water, bitumen, or steam, or may be driven by heat from the steam 212 flowing down the central tubular 208. Thus, the solvent 216 can be selected to flash at the conditions within the middle tubular 210 or at the heel of the well 200. In another embodiment, the solvent and steam may be enclosed in two separate tubular running in parallel down the well casing.

Solvents 216 that can be used for the gas lift can include butanes, pentanes, hexanes, heptanes, octanes, and the like. Further, mixtures of hydrocarbons, such as natural gas liquids useful as diluents for bitumen transportation, may be selected. When diluents are used, lower carbon number components (e.g., butane and pentane, among others) can flash, providing the gas lift, while higher carbon number components (e.g., Nonane, Decane, among others) may remain as liquid. When the injection of the solvent 216 is used to assist the harvesting of bitumen, the liquid components may lower the viscosity of the bitumen, further assisting with the lifting of the production fluids.

As the vapour 218 expands, it flows up an outer annulus between the casing of the upper section 202 and the middle tubular 210 in a mixture 220 with the return flow 217. The expansion of the vapour 218 drives the flow of the mixture 220 up the outer section 202. Bubbles of the vapour 218 within the mixture 220 may also lower the hydrostatic pressure of the mixture 220, further enhancing the flow up outer annulus. At the surface, the mixture 220 can be separated, for example into a hydrocarbon stream and an aqueous stream. The hydrocarbon stream may include bitumen in a mixture with the solvent 216, which may be directly provided to a pipeline for transport. If the solvent 216 has been injected to assist in lifting condensate from the heel 206 of the well 200, it may be reused after separation.

Figure 3:
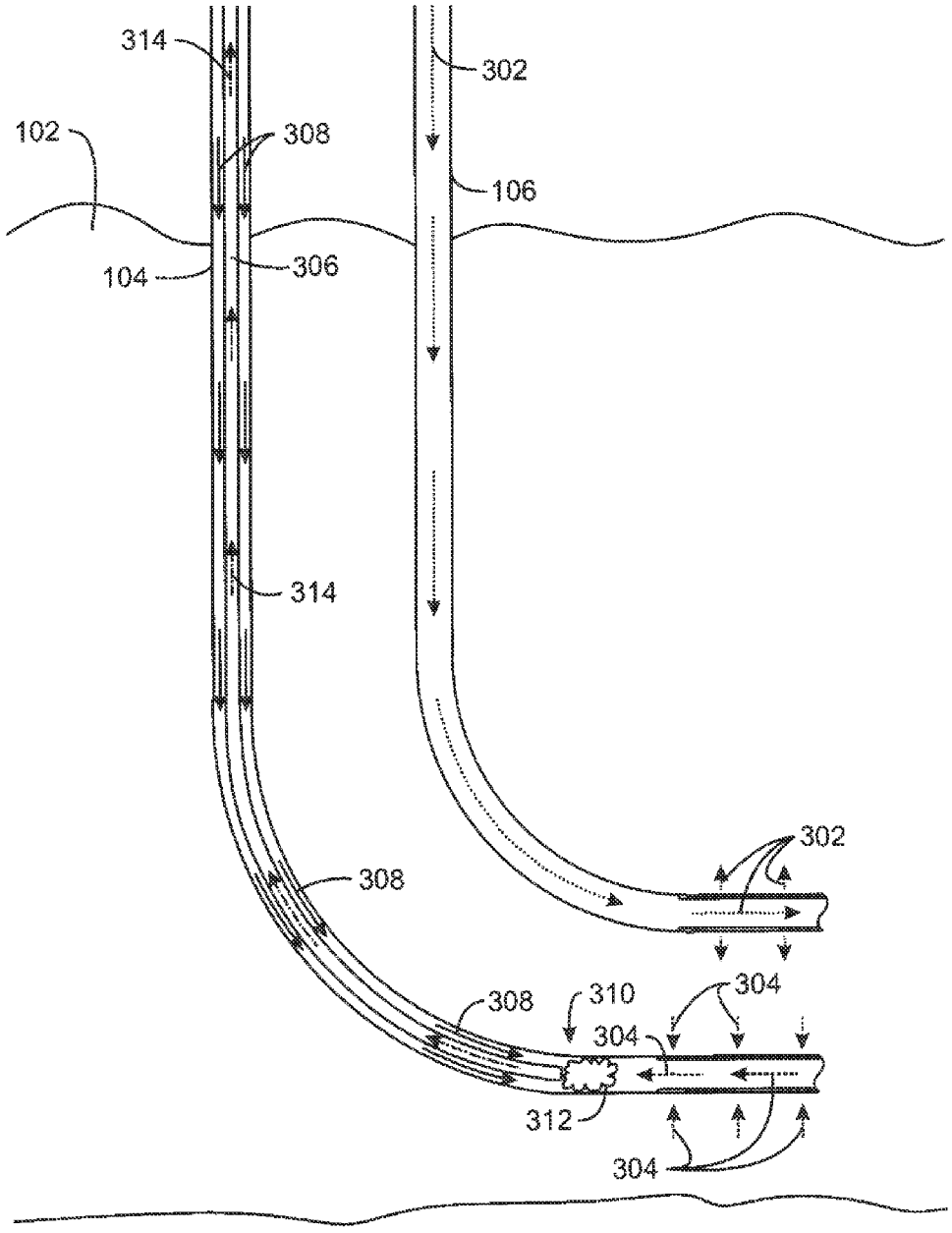
FIG. 3 is a schematic of a steam assisted gravity drainage process using a solvent based gas lift system.

FIG. 3 is a schematic of a steam assisted gravity drainage process using a solvent based gas lift system 300. Like numbered items are as described with respect to FIG. 1. In the solvent based gas lift system 300, an injection well 106 is used to inject steam 302 into a reservoir 102. The steam 302 mobilizes production fluids 304 in the reservoir 102, which flow to a production well 104. The production fluids 304 are a mixture of heated bitumen and condensate from the steam 302. The annulus between the tube 306 and the casing of the production well 104 can carry a solvent 308 to the heel 310 of the production well 104. At the heel 310, the solvent 308 may be injected into the production well 104, contacting the hot production fluids 304. The solvent 308 at least partially flashes into a vapour 312 upon contacting the production fluids 304. The vapour 312 mixes with the production fluids 304 and the mixture 314 flows up the tube 306 to surface. When water vapour is mixed with liquid hydrocarbons, a volume of the water vapour will condense and a much larger volume of hydrocarbon will be vaporized thus providing the gas lift effect. The high heat capacitance of liquid water also has the capability to vaporize significant volumes of liquid hydrocarbon. Thus, the techniques described herein may be particularly valuable in processes such as SAGD where the produced fluids are composed of a significant fraction of high temperature water or steam. Note that an alternative to injecting down the annulus would be to install a second tubing string adjacent to 306 which could be used for the purpose of injecting the solvent 308.

The injection point for the solvent 308, e.g., the point at which the tube ends, is not limited to the point shown, but may be at any practical point within the production well 104. For example, the solvent 308 may be injected at the toe (not shown) of the production well 104, and flash into a vapour as the solvent contacts production fluids 304 flowing into the production well 104. Although steam 302 is used to carry heat into the production well 104 in this example, other fluids may be used to provide the energy to flash the solvent 308 into a vapour 312. For example, hot water may be used to carry the energy to the solvent 308. Further, the solvent 308 may be heated at the surface and injected as a heated fluid. Upon being released into the production well 104 at the heel 310, the hot solvent 308 may flash into a vapour 312 providing the lift for the production fluids 304. Any combinations of hot transfer fluids and hot solvents may be used to provide the energy used to flash the solvent 308.

Figure 4:
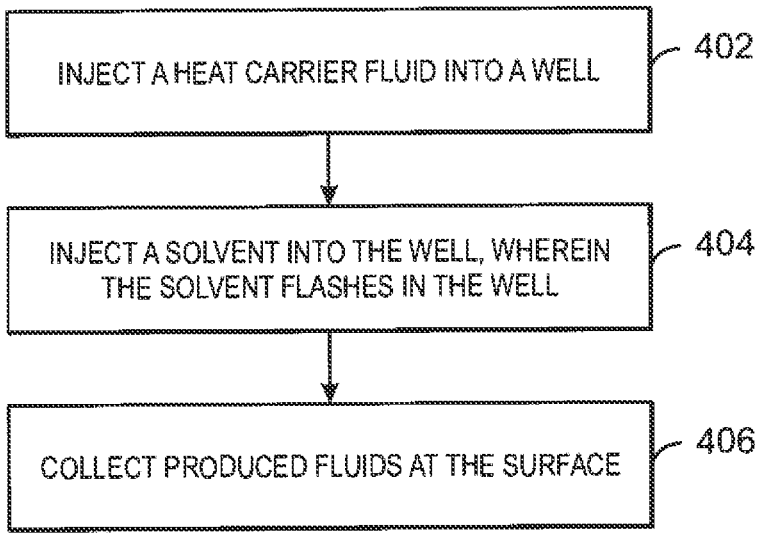
FIG. 4 is a process flow diagram of a method for providing a gas lift system with a solvent that flashes in a well.

FIG. 4 is a process flow diagram of a method 400 for providing a gas lift system with a solvent that flashes in a well. The method begins at block 402 with the injection of a heat carrier fluid into a well. The heat carrier fluid may be steam, hot water, or any other heated fluid selected to provide the energy for the solvent based gas lift. At block 404, a solvent selected to flash in the well may be injected. The solvent may be a diluent that partially flashes, or a solvent that completely flashes at the conditions in the well. The solvent can be injected into the same well as the heat transfer fluid, for example, as described with respect to FIG. 2, or may be injected into a separate well, for example, as described with respect to FIG. 3. At block 406, the produced fluids are collected at the surface. If the fluids do not include a bitumen product, for example, when the techniques are used to lift condensate to the surface, the solvent may be separated out and reused in the lift procedure. If the produced fluids do include a bitumen product, an aqueous phase may be separated from the organic phase containing the solvent and bitumen mixture, and the organic phase can then be shipped as the product.

Embodiments

Embodiments of the techniques described herein can include any combinations of the elements described in the following numbered paragraphs:

1. A method for lifting fluids from a reservoir, including:
   injecting a heat carrier fluid including steam, hot water, or both into a first well;
   injecting an organic compound into a second well, wherein the organic compound is selected to vaporize to a gas from the heat provided by the heat carrier fluid, forcing produced fluids to the surface through the second well; and
   collecting the produced fluids at the surface.
2. The method of paragraph 1, including:
   separating the organic compound from the produced fluids; and
   repeating the injection of the heat carrier fluid and the produced fluids into the second well.
3. The methods of paragraphs 1 or 2, including:
   separating water from the produced fluids; and
   shipping the produced fluids as a mixture with the organic compounds.
4. The methods of paragraphs 1, 2, or 3, wherein the first well and the second well are the same.
5. The methods of any of the preceding paragraphs, wherein the first well includes an injection well in an oil-sands reservoir.
6. The methods of any of the preceding paragraphs, wherein the second well includes a production well in an oil sands reservoir.
7. The methods of any of the preceding paragraphs, wherein the organic compound includes alkanes.
8. The methods of any of the preceding paragraphs, wherein the produced fluids include reservoir hydrocarbons.
9. A system for harvesting resources in a reservoir, including:
   a production well including a horizontal section located substantially proximate to a base of the reservoir;

an injection system configured to inject an organic compound into an tube in the production well, wherein the organic compound is selected so as to vaporize at the end of the tube; and a continuous production system configured to produce a fluid from the production well, wherein the fluid includes a bitumen and the organic compound.

10. The system of paragraph 9, including an injection well configured to inject steam into the reservoir.

11. The systems of paragraphs 9 or 10, wherein the production well includes a plurality of annulus, wherein:

a first annulus is configured for steam injection;

a second annulus is configured for solvent injection; and a third annulus is configured for production of fluids from the reservoir.

12. The systems of paragraphs 9, 10, or 11, including a separation system configured to separate water from the fluids.

13. The systems of any of paragraphs 9-12, including an injection well configured to inject steam into the reservoir.

14. The systems of any of paragraphs 9-13, including a tube in the injection well configured to inject an organic compound into the injection well at the heel, wherein the organic compound is selected to flash at the conditions in the heel or the injection well.

15. A method for harvesting hydrocarbons from a reservoir, including:

drilling a production well substantially proximate to a base of a reservoir;

injecting steam into the reservoir to lower a viscosity of bitumen, wherein the bitumen flows into the production well;

injecting an organic compound in the liquid phase into the production well, wherein the organic compound flashes into a vapour in the production well; and producing fluids from the production well, wherein the fluids include the vapour and the bitumen.

16. The method of paragraph 15, wherein the fluids include the liquid phase of the organic compound.

17. The methods of paragraphs 15 or 16, including drilling an injection well at greater than about three meters shallower than the production well.

18. The methods of paragraphs 15, 16, or 17, including:

injecting steam into the reservoir through a first annulus in the production well;

injecting the organic compound into the production well through a second annulus in the production well; and producing the fluids through a third annulus in the production well.

19. The methods of any of paragraphs 15-18, including injecting a non-condensable gas with the organic compound.

20. The methods of any of paragraphs 15-19, including injecting a mixture of the organic compound with a diluent, wherein the diluent remains as a liquid in the production well.

21. The methods of any of paragraphs 15-20, including injecting a mixture of the organic compound, a non-condensable gas, and a diluent, wherein the diluent remains as a liquid in the production well.

22. The methods of any of paragraphs 15-21, including adjusting an injection rate of the organic compound to minimize geysering at the surface.

23. The methods of any of paragraphs 15-22, including injecting hot water, steam, or both, in a physical combination with the organic compound, wherein the organic compound remains as a liquid in the vertical portion of the production well and flashes to a gas at the heel of the well.

24. The methods of any of paragraphs 15-23, including injecting a diluent as the organic compound, wherein the diluent comprises components that remain as a liquid in the production well and components that flash to a gas in the production well.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A method for lifting fluids from a reservoir, comprising:

injecting a heat carrier fluid comprising steam, hot water, or both into a first well;

producing produced fluids in a second well from the reservoir;

injecting an organic compound into the second well while producing the produced fluids from the reservoir, wherein the organic compound is selected to vaporize to a gas from heat provided by the heat carrier fluid, lifting the produced fluids to a surface through the second well; and collecting the produced fluids at the surface.

2. The method of claim 1, comprising:

separating the organic compound from the produced fluids;

injecting the produced fluids into the second well; and repeating the injection of the heat carrier fluid and the produced fluids into the second well.

3. The method of claim 1, comprising:

separating water from the produced fluids; and shipping the produced fluids as a mixture with the organic compounds.

4. The method of claim 1, wherein the first well and the second well are the same.

5. The method of claim 1, wherein the first well comprises an injection well in an oil-sands reservoir.

6. The method of claim 1, wherein the second well comprises a production well in an oil sands reservoir.

7. The method of claim 1, wherein the organic compound comprises alkanes.

8. The method of claim 1, wherein the produced fluids comprise reservoir hydrocarbons.

9. The method of claim 1, comprising flashing the organic compound into a vapour at a temperature and a pressure at a heel of the production well.

10. A system for harvesting resources in a reservoir, comprising:

a production well comprising a horizontal section located substantially proximate to a base of the reservoir;

an injection system configured to inject an organic compound into a production well tube in the production well while a fluid is produced in the production well, wherein the organic compound is selected so as to vaporize at the end of the production well tube; and a continuous production system configured to produce the fluid from the production well, wherein the fluid comprises a bitumen and the organic compound.

11. The system of claim 10, comprising an injection well configured to inject steam into the reservoir.

12. The system of claim 10, wherein the production well comprises a plurality of annuli, wherein:

a first annulus is configured for steam injection;

a second annulus is configured for solvent injection; and a third annulus is configured for production of fluids from the reservoir.

13. The system of claim 10, comprising a separation system configured to separate water from the fluid.

14. The system of claim 10, comprising an injection well tube in an injection well configured to inject an organic compound into the injection well at a heel, wherein the organic compound is selected to flash at conditions in the heel or the injection well.

15. The system of claim 10, wherein the organic compound is selected so as to flash into a vapour at a temperature and a pressure at a heel of the production well.

16. A method for harvesting hydrocarbons from a reservoir, comprising:

drilling a production well substantially proximate to a base of a reservoir;

injecting steam into the reservoir to lower a viscosity of bitumen, wherein the bitumen flows into the production well;

injecting an organic compound in a liquid phase into the production well, wherein the organic compound flashes into a vapour in the production well; and producing fluids from the production well while injecting the organic compound, wherein the fluids comprise the vapour and the bitumen.

17. The method of claim 16, wherein the fluids comprise the liquid phase of the organic compound.

18. The method of claim 16, comprising drilling an injection well at greater than about three meters shallower than the production well.

19. The method of claim 16, comprising:

injecting steam into the reservoir through a first annulus in the production well;

injecting the organic compound into the production well through a second annulus in the production well; and producing the fluids through a third annulus in the production well.

20. The method of claim 16, comprising injecting a non-condensable gas with the organic compound.

21. The method of claim 16, comprising injecting a mixture of the organic compound with a diluent, wherein the diluent remains as a liquid in the production well.

22. The method of claim 16, comprising injecting a mixture of the organic compound, a non-condensable gas, and a diluent, wherein the diluent remains as a liquid in the production well.

23. The method of claim 16, comprising adjusting an injection rate of the organic compound to minimize geysering at a surface.

24. The method of claim 16, comprising injecting hot water, steam, or both, in a physical combination with the organic compound, wherein the organic compound remains as a liquid in a vertical portion of the production well and flashes to a gas at a heel of the production well.

25. The method of claim 16, comprising injecting a diluent as the organic compound, wherein the diluent comprises components that remain as a liquid in the production well and components that flash to a gas in the production well.

26. The method of claim 16, comprising flashing the organic compound into a vapour at a temperature and a pressure at a heel of the production well.

* * * * *